United States Patent [19]

Wada et al.

[11] Patent Number: 4,514,480

[45] Date of Patent: Apr. 30, 1985

[54] METHOD OF CONTROLLING TONER CONCENTRATION FOR ELECTROPHOTOGRAPHIC COPYING APPARATUS

[75] Inventors: Kenichi Wada, Sakai; Tateki Oka, Toyohashi; Kenji Tabuchi, Toyokawa, all of Japan

[73] Assignee: Minolta Camera Kabushiki Kaisha, Osaka, Japan

[21] Appl. No.: 503,776

[22] Filed: Jun. 13, 1983

Related U.S. Application Data

[63] Continuation-in-part of Ser. No. 329,204, Dec. 9, 1981, abandoned.

[30] Foreign Application Priority Data

Dec. 19, 1980 [JP] Japan ..... 55-181030
Oct. 26, 1981 [JP] Japan ..... 56-171617

[51] Int. Cl.[3] ..... G03G 13/09

[52] U.S. Cl. ..... 430/30; 430/97; 430/122; 118/690; 118/657; 355/14 D

[58] Field of Search ..... 118/688, 690, 665, 657, 118/658; 430/30, 122, 39, 97; 355/3 DD, 14 D

[56] References Cited

U.S. PATENT DOCUMENTS

| | | | |
|---|---|---|---|
| 3,348,521 | 10/1967 | Hawk | 355/14 D X |
| 3,707,134 | 12/1972 | Gawron | 118/657 X |
| 4,088,092 | 5/1978 | Noguchi | 118/653 X |
| 4,141,645 | 2/1979 | Reid et al. | 355/3 DD |
| 4,347,299 | 8/1982 | Ozawa et al. | 355/3 DD X |
| 4,405,226 | 9/1983 | Kimura et al. | 355/3 DD X |

*Primary Examiner*—John D. Welsh
*Attorney, Agent, or Firm*—Wenderoth, Lind & Ponack

[57] ABSTRACT

An improved method of controlling toner concentration for electrophotographic copying apparatus employing a dual component developing material which is composed of toner particles and magnetic particles. The method is arranged to detect the amount of magnetic particles adhering onto a photosensitive member for controlling the toner replenishing amount according to the amount of the magnetic particles thus detected.

8 Claims, 9 Drawing Figures

METHOD OF CONTROLLING TONER CONCENTRATION FOR ELECTROPHOTOGRAPHIC COPYING APPARATUS

BACKGROUND OF THE INVENTION

This application is a continuation-in-part application of U.S. patent application Ser. No. 329,204, filed Dec. 9, 1981, now abandoned.

The present invention generally relates to an electrophotographic process and more particularly to a method of controlling toner concentration for an electrophotographic copying apparatus in which an electrostatic latent image formed on a photosensitive member is developed by a magnetic brush developing device employing a dual component developing material.

Commonly, in electrophotographic copying apparatuses, electronic printers, etc., when an electrostatic latent image is to be developed by a dual or two component developing material, it is difficult to obtain a predetermined image density unless the mixing ratio of toner to carrier in the developing material is maintained at a proper value. Accordingly, there have conventionally been proposed various toner concentration control methods for maintaining the mixing ratio at the proper value through replenishment of toner upon reduction of the mixing ratio due to consumption of the toner in the developing material at each developing. However, the known methods as described above generally have such disadvantages that apparatuses employed therefor have a complicated structure or that detection of toner concentration thereby is not necessarily accurate. Of the prior art methods referred to above, the method disclosed, for example, in Japanese Laid Open Patent Application Tokkaisho No. 54-61938 is comparatively superior, and includes such steps that, with a reference image in black provided at a leading edge or trailing edge of an original platform, the reference image is projected for exposure onto a corresponding leading edge or trailing edge outside a transfer area of a photosensitive member each time the original to be copied is exposed so as to form a latent image for the toner concentration control area thereat, and said control latent image is developed during developing process together with an electrostatic latent image of the original for forming a toner concentration control image, and subsequently light reflected by said toner concentration control image is detected by a photoelectric conversion element between a transfer process and a cleaning process for accurately controlling the amount of replenishing toner to be supplied by means of a comparison circuit according to the density of said toner concentration control image.

The known method as described above, however, still has problems as described hereinbelow.

Commonly, in electrophotographic copying apparatuses, an exposure amount variation knob is provided to adjust copying density, and is so arranged that, for increasing the copying density, the exposure amount is reduced, while for increasing the copying density, the exposure amount is increased.

In other words, when it is intended to increase the copying density by reduction of the exposure amount, the density of the above toner concentration control image is also increased, and therefore, toner is not replenished or the amount thereof supplied is small in this case. High copying density means that the amount of toner consumption is large, and if toner is not replenished, the toner concentration is lowered, and consequently, the copying density is not increased. On the contrary, if it is desired to lower the copying density or to remove fogging on the background through increase of the exposure amount, the density of said toner concentration control image is also lowered, and thus, toner is replenished or the amount thereof supplied is increased. Accordingly, since the toner concentration is raised despite the intention to decrease the copying density, said copying density is not lowered. Exactly the same situation as above applies to fogging, and also to the case where a copying apparatus of a type in which the copying density is adjusted through variation of developing bias voltage is employed. For the compensation of the disadvantages as described above, one might conceive of forming the toner concentration image portion as described above, by a constant amount of light and by a constant bias potential at all times for carrying out detection, but in such a case, the apparatus employed therefor may be undesirably complicated.

SUMMARY OF THE INVENTION

Accordingly, an essential object of the present invention is to provide an improved method of controlling toner concentration for an electrophotographic copying apparatus which is constructed to detect the amount of magnetic particles adhering to a photosensitive member for controlling the amount of replenishing toner supplied according to the amount of the magnetic particles thus detected.

Another important object of the present invention is to provide an improved method of controlling toner concentration as described above which may be applied to a process employing a reference image as referred to earlier for eliminating the disadvantages inherent therein.

A further object of the present invention is to provide an improved method of controlling toner concentration as described above which requires only an arrangement having a simple construction and which is efficient in use, and which can be readily incorporated into electrophotographic copying machines of this kind.

In accomplishing these and other objects, according to one preferred embodiment of the present invention, there is provided a method of controlling toner concentration for use in an electrophotographic copying apparatus in which an electrostatic latent image formed on a photosensitive member is subjected to magnetic brush development by impression of a developing bias voltage having the same polarity as that of the electrostatic latent image and with the use of a dual component developing material composed of toner particles and magnetic particles which are triboelectrically charged to polarities different from each other. The above toner concentration control method includes the steps of detecting the amount of the magnetic particles adhering to the photosensitive member, and controlling the amount of replenishing toner supplied according to the amount of the magnetic particles thus detected.

By the particular steps as described above, an improved method of toner concentration control has been advantageously provided with substantial elimination of disadvantages inherent in the conventional methods of this kind.

BRIEF DESCRIPTION OF THE DRAWINGS

These and other objects and features of the present invention will become apparent from the following description of a preferred embodiment thereof taken in conjunction with the accompanying drawings, in which.

Before the description of the present invention proceeds, it is to be noted that like parts are designated by like reference numerals and symbols throughout several views of the accompanying drawings.

DETAILED DESCRIPTION OF THE INVENTION

Figure 1:
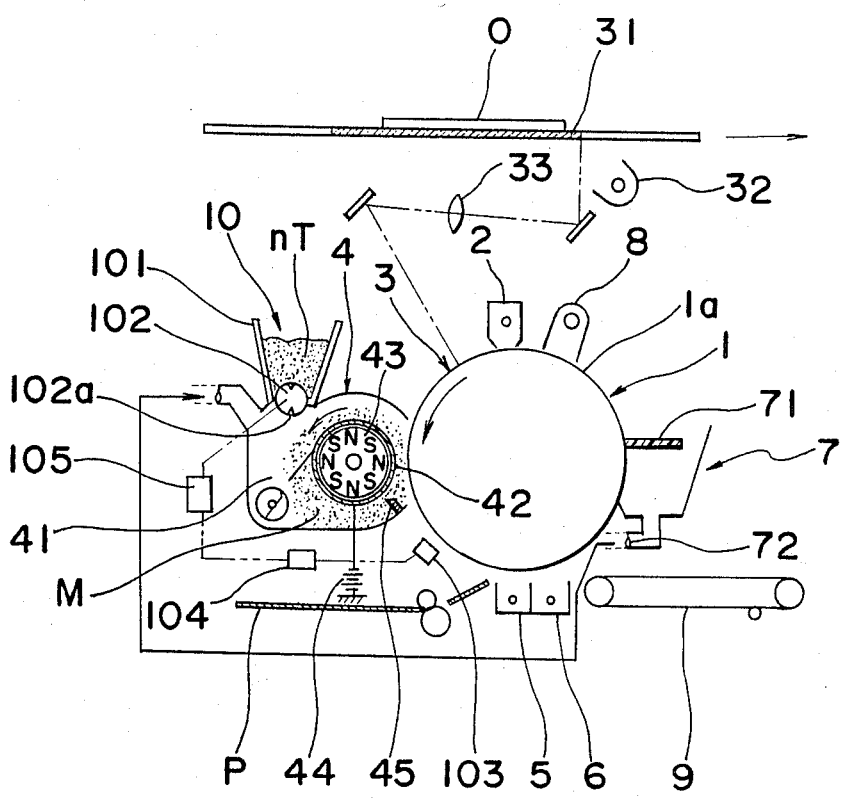
FIG. 1 is a schematic side elevational view of an electrophotographic copying apparatus by which a method of controlling toner concentration according to the present invention may be carried out.

The present inventors have already proposed, for example, in U.S. Pat. No. 4,282,702 that, in a magnetic brush developing device which uses a dual component developing material composed of toner particles and carrier particles, when high resistance magnetic particles (referred to merely as micro-carrier particles hereinbelow), produced by dispersing fine magnetic particles into an electrically insulative resin and having a volume resistivity higher than $10^{10}$ Ω.cm, with particle sizes approximately the same (i.e. 5 to 40 μm) as those of the toner particles, are employed as the carrier particles, the bristles of the magnetic brush become softer, while the surface areas of said carrier particles are greatly increased as compared with large diameter carrier particles of the same total weight, thus resulting in such advantages that good quality copies may be obtained at a high resolving power without fogging, and that the allowance for the toner mixing ratio is also increased, with a consequent improvement in durability of the carrier particles. In the magnetic brush developing apparatus as described above, a bias voltage having the same polarity as that of an electrostatic latent image is impressed on the toner to prevent the toner from adhering to non-image portions, and since the micro-carrier particles as described earlier are charged with a polarity opposite to the charge of the toner particles by frictional contact thereof with said toner particles, adhesion of a certain amount of carrier to the non-image portions takes place depending on the set value of said bias voltage, the amount of charge on the micro-carrier particles, and state of residual potential at the non-image portions (white portions of the original to be copied) through image exposure, etc., and in the adhering phenomenon as described above, when the bias voltage is set at approximately the same potential as the potential at the non-image portions, the residual potential at the non-image portions is also varied according to an increase or decrease of the image exposure amount in such a manner that when the exposure amount is large, the residual potential is lowered, and the carrier adhesion tends to occur through inversion of the developing potential difference due to the bias voltage. In the above connection, it has been found by the present inventors that, only a small amount of carrier adhesion takes place when the toner concentration, i.e. the mixing ratio of the toner particles is 10 weight % at standard, and that the amount of toner adhering is also increased or decreased according to the increase or decrease of the exposure amount and toner concentration. Meanwhile, with respect to the carrier adhesion, owing to the fact that the micro-carrier particles are small in diameter, and also charged to a polarity opposite to that of the toner particles, there is no possibility that they are transferred during the transfer process to spoil copied images.

With attention directed to the fact that the amount of the micro-carrier particles adhering to the non-image portions is in a fixed relation with respect to the variation of toner concentration, or that such amount of particles adhering increases in proportion to the amount of charge on the micro-carrier particles, or more specifically, that the amount of particles adhering increases with an increase of the toner concentration, the present inventors carried out experiments in which, by detecting the amount of the micro-carrier particles adhering, the amount of replenishing toner supplied was controlled according to the amount of adhering micro-carrier particles thus detected, the results of which were satisfactory, and it has been ensured that the objects of the present invention can be sufficiently achieved by the above method.

As described earlier, the present invention has for its further object to provide a method of controlling toner concentration which may be applied to a process employing a reference image as in the Japanese Laid Open Patent Application Tokkaisho No. 54-61938, without the disadvantages as explained previously.

The present inventors have directed attention to the fact that, in the magnetic developing device as described in the foregoing, by causing the micro-carrier particles to adhere to the non-image portions, when a reference image of the same color as the non-image portions of the original, i.e. of white shade is produced, exactly the same relation as previously stated, i.e. the relation that a certain amount of carrier particles adheres to the electrostatic latent image according to the set value of the bias voltage, the amount of charge on the micro-carrier particles and state of the residual potential of the toner concentration control latent image which is based on the white reference image to be formed on the photosensitive member together with the electrostatic latent image through exposure during the image exposure process, and that the amount of the carrier particles adhering as described above is in a fixed relation with respect to variation of the toner concentration, i.e. the relation in which said amount of toner particles adhering is increased in proportion to the amount of charge on the micro-carrier particles. In other words, the amount of particles adhering increases as the toner concentration becomes higher, and thus, by control of the amount of replenishing toner supplied according to the detected amount of the carrier particles adhering to the toner concentration control latent image based on the white reference image, the result has been confirmed to be so satisfactory that the object of the present invention can be fully achieved.

More specifically, the present invention is particularly characterized in that, in an electrophotographic copying apparatus in which the electrostatic latent image formed on the photosensitive member is subjected to magnetic brush development by the dual component developing material including the toner particles and magnetic particles triboelectrically charged to different polarities, by impression of a developing bias voltage of the same polarity as that of said latent image, the amount of the magnetic particles adhering to the photosensitive member is detected and the amount of replenishing toner supplied is controlled according to the amount thus detected. Accordingly, the disadvantages in the conventional control methods as that the copy density is not raised due to lowering of the toner concentration when a dark copy is required, are eliminated, and copies of desired density can be obtained more quickly and accurately.

The present invention is also characterized in that, in an electrophotographic copying apparatus in which the electrostatic latent image formed on the photosensitive member by the charging and image exposure processes is subjected to magnetic brush development by the dual component developing material including the toner particles and magnetic particles triboelectrically charged to different polarities, by impression of a developing bias voltage of the same polarity as that of said latent image, an electrostatic latent image corresponding to an original to be copied is formed on the photosensitive member by exposure thereof to the light image of the original having white non-image portions, and in the developing process, the non-image portions of the latent image in which the developing potential difference is inverted by the above bias voltage are developed, while the amount of the magnetic particles adhering to said non-image portions is detected and the amount of replenishing toner supplied is controlled according to the amount thus detected. In the above method of the present invention, since it is not necessary to detect at the leading edge or trailing edge outside the area required for the transfer by the use of the reference image as in the conventional methods, and the detection can be effected at the non-image portion of the original, no extra space for such a detecting means is required in the apparatus, thus resulting in such additional advantages that reduction of size and simplification of structure become possible.

More specifically, the present invention is further characterized in that, in an electrophotographic copying apparatus in which the electrostatic latent image formed on the photosensitive member is subjected to magnetic brush development by a dual component developing material including toner particles and magnetic particles triboelectrically charged to different polarities, by impression of a developing bias voltage of the same polarity as that of said latent image a white reference image provided in a position different from the original is subjected to exposure at each exposure process of the original to form a toner concentration control latent image on the photosensitive member, and in the developing process, said control latent image in which the developing potential difference is inverted by the bias voltage is developed and the amount of the magnetic particles adhering to said control latent image is detected and the amount of replenishing toner supplied is controlled according to the amount thus detected. The above method according to the present invention has such advantages that copies having the desired correct density may be obtained, even from originals having non-image portions which are not white, but colored.

Referring now to the drawings, there is schematically shown in FIG. 1 an electrophotographic copying apparatus in which a first method of controlling toner concentration according to the present invention can be carried out.

In the copying apparatus of FIG. 1, at approximately the central portion thereof, a photosensitive of photoreceptor drum 1 having a photosensitive or light receiving surface 1*a* provided therearound is rotatably mounted for rotation in the counterclockwise direction as indicated by the arrow, around which photoreceptor drum 1 there are sequentially disposed in a known manner a corona charger 2 for uniformly charging the photosensitive surface 1*a*, an image exposure device 3 for projecting a light pattern of an original to be copied onto the phtosensitive surface 1*a* so as to form an electrostatic latent image of the original thereon, a developing device 4 for developing the latent image thus formed into a visible toner image by the developing material, a transfer corona charger 5 for electrostatically transferring the toner image onto a transfer material such as a copy paper sheet P, a copy paper separation corona charger 6, a cleaning device 7 and an eraser lamp 8, etc.

In the copying apparatus of FIG. 1 as described above, the image exposure device 3 is a type in which a transparent platform 31 carrying thereon an original O to be copied is adapted to scan, and is so constructed that the light image of the original O illuminated by an exposure lamp 32 provided below and adjacent to the platform 31 is successively projected onto the photosensitive surface 1*a* of the drum 1 uniformly charged by the corona charger 2, through an optical system 33 so as to form the electrostatic latent image corresponding to the original O on the photosensitive surface 1*a* for developing said latent image by the subsequent developing device 4.

It should be noted here that in the above arrangement, the amount of exposure is adjusted by varying the light amount of light emitted by the exposure lamp 32 through operation of a control knob (not shown) provided on a control panel (not shown).

On the other hand, the copy paper sheet P fed by a copy paper feeding device (not shown) provided at the lower left portion of FIG. 1 has the toner image formed on the photosensitive surface 1*a* of the drum 1 transferred thereto by the transfer charger 5 at the transfer position, and then is separated from the surface 1*a* of the drum 1 by the separating charger 6 and is further transported by a transport belt 9 out of the apparatus after the transferred image has been fixed thereto by a fixing device (not shown).

The cleaning device 7 disposed subsequent to the separation corona charger 6 is a type which scrapes off the developing material remaining on the photosensitive surface 1*a* after the transfer by keeping a blade 71 in sliding contact with said photosensitive surface 1*a* of the drum 1, and the developing material thus scraped off is again returned to the developing device 4 through a circulation pipe 72 for repeated use for further development. Meanwhile, the residual potential on the photosensitive surface 1*a* is dissipated by the eraser lamp 8. The developing device 4 is a magnetic brush type which includes, for example, a rotary developing sleeve or outer cylinder 42 and a stationary magnet member 43 fixedly enclosed in said developing sleeve 42. The rotary developing sleeve 42 of electrically conductive material arranged to be driven for rotation in the counterclockwise direction is provided in a position adjacent to the photosensitive surface 1*a* of the drum 1 within a developing tank 41, while the stationary magnet member 43 having a plurality of magnetic poles therearound in alternately different polar orientation is fixedly provided within said developing sleeve 42. The above arrangement may be so modified that the magnet member 43 is also adapted to rotate. On the developing tank 41 of the developing device 4, there is disposed an automatic toner dispensing device 10 (to be described later).

In the embodiment according to the present invention to be described hereinbelow, there is employed a dual component developing material M comprising non-magnetic toner particles (nT), and micro-carrier particles (mC) which are composed of high resistance magnetic particles prepared by dispersing magnetic fine particles in an electrically insulative resin and having comparatively small particle diameters (average particle diameter of 16$\mu$ to 18$\mu$) and with a volume resistivity higher than $10^{13}$ $\Omega$.cm. In the case where the electrostatic latent image formed on the photosensitive surface 1*a* of the photoreceptor drum 1 has a negative charge, the toner particles (nT) and the carrier particles (mC) are arranged to be respectively charged, through frictional contact therebetween, to a positive polarity for the toner particles (nT) and a negative polarity for the carrier particles (mC). Meanwhile, the developing sleeve 42 is impressed with a bias voltage of the same polarity as the electrostatic latent image by a bias voltage source 44 so as to prevent the toner (nT) from adhering to the non-image portion of said electrostatic latent image.

By the above arrangement, the developing material M formed on the developing sleeve 42 into the configuration of brush bristles whose height is made uniform by a bristle height restriction member 45 disposed adjacent to the peripheral surface of said developing sleeve 42, rubs against the electrostatic latent image formed on the photoreceptor drum 1, and thus the toner particles (nT) adhere only to the image portions to effect the development of said latent image. However, as the ratio of the toner particles (nT) in the developing material increases, the carrier particles (mC) are sufficiently triboelectrically charged so that the amount of charge thereon is increased, and by the potential difference (positive potential) at the non-image portions owing to the bias voltage of the negative polarity impressed on the developing sleeve 42, the carrier particles (mC) having the negative charge adhere to the non-image portion by overcoming the retaining force of the magnet member 43 disposed within the developing sleeve 42. The amount of carrier particles adhering as described above is increased in proportion to the amount of charge on the carrier particles (mC), i.e. in a relation such that the amount of adhering particles is increased with an increase in the ratio of the toner particles (nT) in the developing material.

Hereinbelow, EXAMPLES are set forth for the purpose of illustrating the present invention, without any intention of limiting the scope thereof.

EXAMPLE 1

Figure 2:
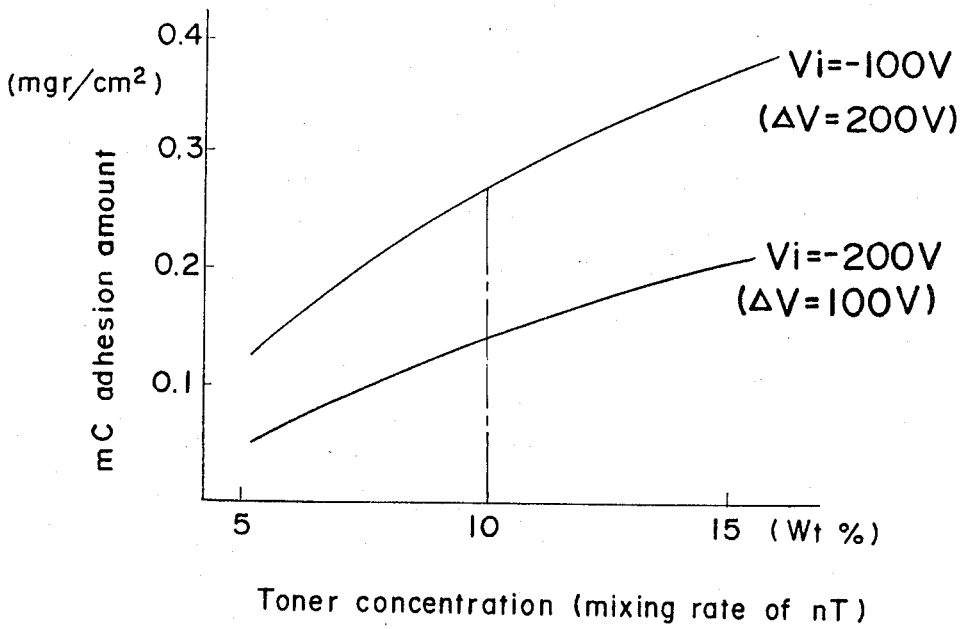
FIG. 2 is a graph showing the relation between the toner concentration and the amount of adhesion of micro-carrier (mC)

There was provided a photosensitive member 1*a* formed by bonding fine particles of CdS and $CdCO_3$ with resin, and with the highest potential at the image portion of the electrostatic latent image set to $-550$ V, the clearance between the photosensitive surface 1*a* of the photoreceptor drum 1 and the developing sleeve 42 to 0.7 mm the magnetic force of the magnet member 43 at the surface of the developing sleeve 42 to 750 gauss, the speed of rotation of the developing sleeve 42 to 300 r.p.m., and the bias voltage on the developing sleeve 42 to $-300$ V, the apparatus of FIG. 1 was operated using a dual component developing material M which included non-magnetic toner particles (nT) prepared by mixing 100 parts by weight of styrene-acrylic resin PLIORITE ACL (name used in trade and manufactured by Good Year Chemical Industries, Ltd., of Japan), 8 parts by weight of carbon black (a coloring agent manufactured by Mitsubishi Chemicals Industries, Ltd., of Japan) and 1 part by weight of nigrosine (a dye manufactured by Orient Chemical Industries, LTD., of Japan), with subsequent mechanical grinding thereof, and having average particle diameters in the range of 10 to 15 $\mu$m and resistance values higher than $10^{14}\Omega$.cm, and micro-carrier particles (mC) prepared by mixing 100 parts by weight of styrene acrylic-resin HYMER SBM-73 (name used in trade and manufactured by Sanyo Chemical Industries, Ltd., of Japan), 200 parts by weight of magnetic fine particles MAGNETITE RB-BL with a particle diameter of about 0.6 $\mu$m and volume resistivity of $3\times10^{5}\Omega$.cm (name used in trade and manufactured by Chitan Kogyo Kabushiki Kaisha of Japan) and 8 parts by weight of carbon black (earlier described, with subsequent mechanical grinding thereof, and having average particle diameters in the range of 16 to 18 $\mu$m and resistance values higher than $10^{13}\Omega$.cm. By operating the control knob referred to earlier, the amount of light from lamp 32 was varied, and, with the potential Vi at the non-image portions being set at $-100$ V and $-200$ V respectively, the relation between the amount of the micro-carrier particles (mC) adhering to the non-image portions and the toner concentration ratio of the toner particles (nT)) was investigated, the results of which are shown in FIG. 2, with $\Delta V$ representing the potential difference between the potential Vi at the non-image portion and the bias voltage.

Figure 3:
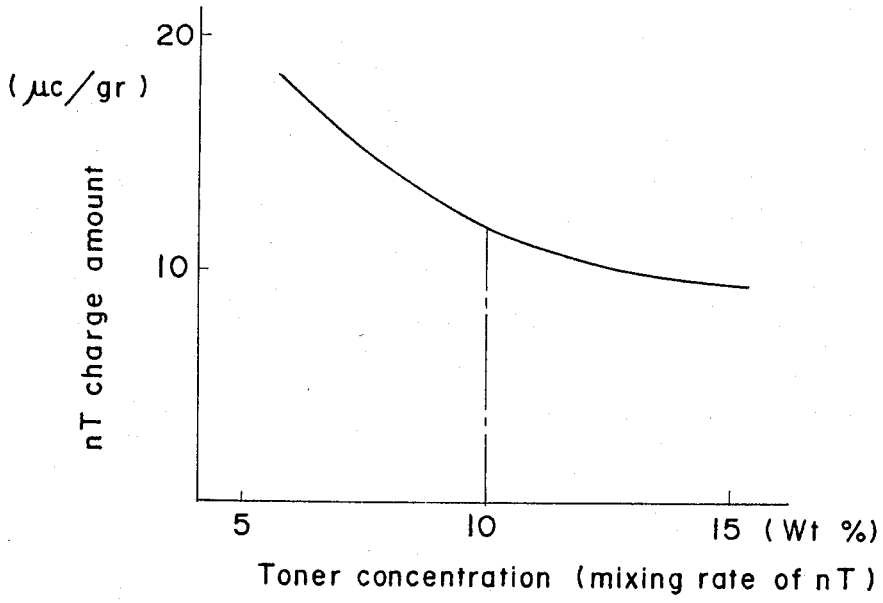
FIG. 3 is a graph showing the relation between the toner concentration and the amount of charge on the toner (nT)

Moreover, the relation between the amount of charge on the toner particles (nT) and the toner concentration ratio of the toner particles (nT)) was also studied, with the results as shown in FIG. 3.

From the results of the experiments as described above, it has been found that, as the toner concentration is increased, the amount of charge on the toner particles (nT) is reduced, while the amount of the carrier particles (mC) adhering to the non-image portions tends to be increased.

According to the present invention, particular attention is directed to the correlation between the toner concentration and the amount of the carrier particles adhering in the developing device as described in the foregoing, and by detecting the amount of the carrier particles adhering to the photosensitive surface of the photoreceptor drum 1, the toner concentration at that time can be found, and in the case where the toner concentration is less than a predetermined value for example, 10 weight %, toner particles (nT) are supplied so as to maintain the toner concentration at the predetermined value, and thus a copying density in the predetermined range is obtained at all times.

It should be noted here that, in the foregoing EXAMPLE 1, although the magnetic particles having average particle diameters in the range of 16 to 18$\mu$, and volume resistivity of $10^{13}\Omega$.cm are described as employed for the micro-carrier particles (mC), the correlation between the toner concentration and the amount, even in the case where magnetic particles having average particle diameters in the range of 5$\mu$ to 40$\mu$ and volume resistivity higher than $10^{10}\Omega$.cm are employed, and results similar to those in the above EXAMPLE 1 may be achieved by detection of the amount of adhesion of the carrier particles adhering to the non-image portions.

The toner concentration control method according to the present invention is effected by utilization of the relation as described in the foregoing, and the automatic toner dispensing device 10 mounted on the developing material tank 41 of the developing device 4 includes a hopper or toner tank 101 containing only toner (nT) and a toner replenishing roller 102 rotatably provided in the lower opening of said toner tank 101. The roller 102 has a plurality of toner replenishing grooves or recesses 102*a* which extend along the surface thereof parallel to the axis thereof to deliver the toner particles (nT) accommodated in the toner tank 101 into the developing material tank 41 for replenishment. Below the developing tank 41 of the developing device 4 and adjacent to the photosensitive surface 1*a* of the photosensitive drum 1, there is provided a detecting system constituted by a detecting section 103 constituted by a magnetic detecting element (not shown) and coupled to the roller 102 through a magnetic and electric converting device 104 and a driving control device 105 for detecting the amount of micro-carrier particles (mC) adhering to the non-image portion after the development of the electrostatic latent image on the photosensitive surface 1*a* of the drum 1. The detected signal from the detecting section 103 is converted into an electrical signal by the magnetic and electrical converting device 104 for input to the driving control device 105 so as to control the rotation of the toner replenishing roller 102 according to the signal as detected above. Such a detecting system is disclosed in U.S. Pat. No. 4,088,092.

Figure 5:
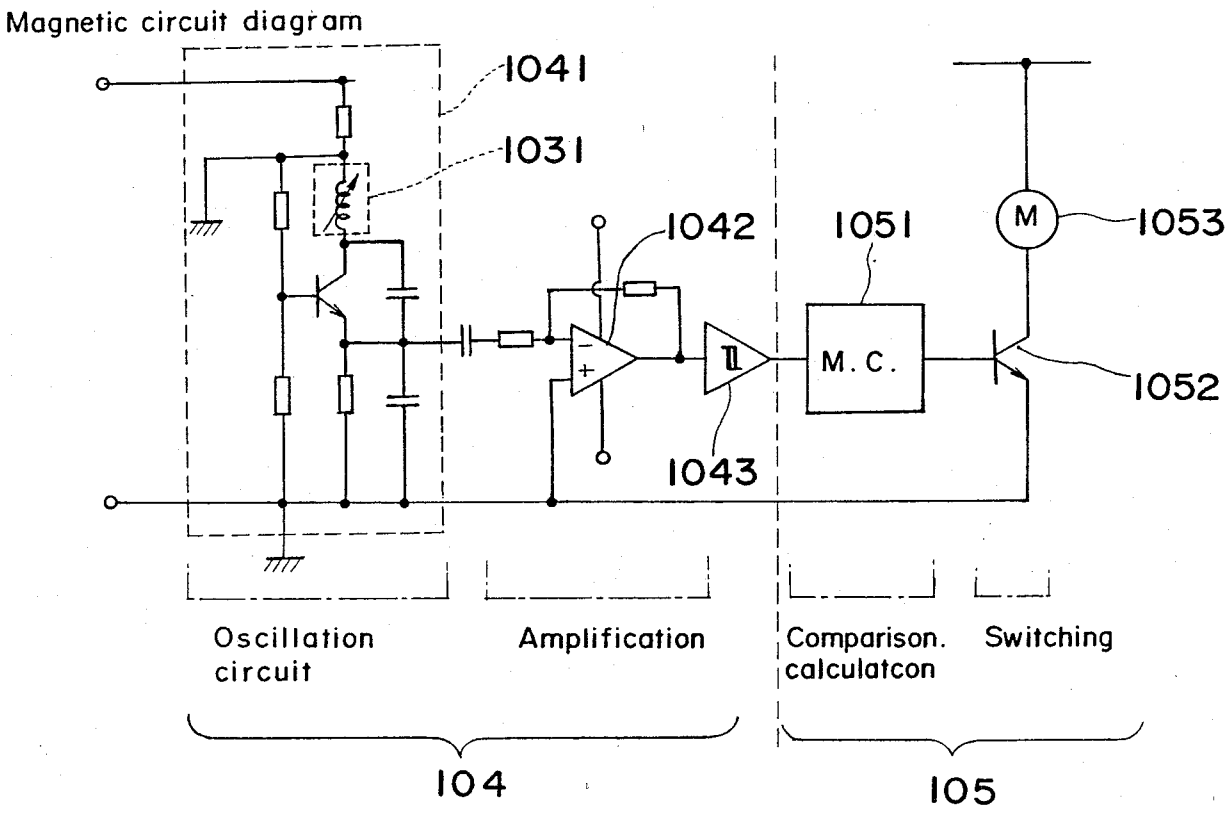
FIG. 5 is a circuit diagram showing one specific example of a detecting system employed in the method according to the present invention.

In a circuit diagram in FIG. 5 showing one specific example of the detecting system (magnetic detecting system) referred to above, there is constituted a known Colpitts type oscillation circuit 1041 as disclosed in the U.S. Pat. No. 4,088,092 by employing a magnetic head 1031 (i.e. inductor) as a resonance element so that oscillation frequency varies through variation in inductance of the magnetic head 1031 by the amount of micro-carrier particles (mC) adhering to the surface 1*a* of the photosensitive drum 1. The output signal of the oscillation circuit 1041 subjected to voltage amplification by an operational amplifier 1042 coupled to said circuit 1041, is shaped in the waveform by a Schmidt trigger gate 1043 inserted between the amplifier 1042 and the micro-computer 1051 so as to be applied to the input port of said micro-computer 1051. The micro-computer 1051 counts the above input waveform for comparison with a count value resulting from the adhering amount of micro-carrier particles (mC) corresponding to the preliminarily set toner concentration, for example, 10 wt%, and if the amount is smaller than the above, produces output at its output port so as to actuate the driving motor 1053 of the toner replenishing roller 102 through a transistor 1052 which is connected, at its base, to the micro-computer 1051 as shown.

Referring also to a flow-chart in FIG. 6, description will be given hereinbelow with reference to the control of the micro-computer 1051.

Figure 6:
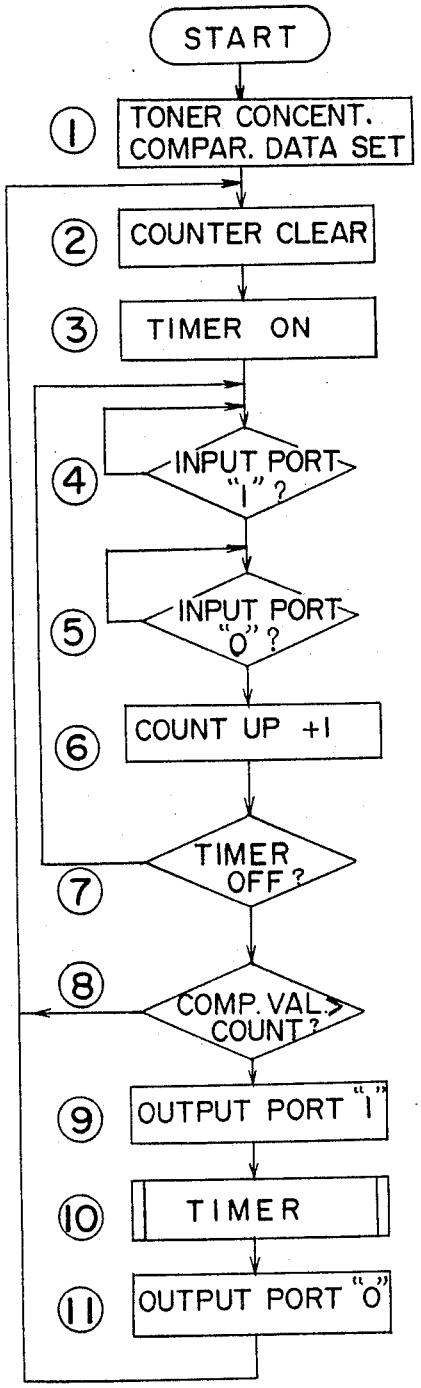
FIG. 6 is a flow-chart explanatory of control of a micro-computer employed in the arrangement of FIG. 5.

In FIG. 6, upon receipt of signal, the micro-computer 1051 is started, and in the first place, comparison data of the toner concentration are set at a step (1), whereby the count value due to the adhering amount of the micro-carrier particles (mC) corresponding to the toner concentration, for example, at 10 wt% is preliminarily set. Subsequently, after clearing a counter for counting the frequency from the oscillation circuit 1041 at a step (2), a timer for obtaining the count number of the frequency in a predetermined period of time is turned on at a step (3). Thus, upon detection that the input port becomes "1" and subsequently, "0" at steps (4) and (5), the counter counts up by one at a step (6), and during a period up to turning off of the timer at a step (7), count number corresponding to the toner concentration is counted at the step (6). Upon turning off the timer at a step (7), the step proceeds to a step (8). At the step (8), when the count number is smaller than the comparison count value, the step proceeds to a step (9), whereat the output port of the micro-computer 1051 is set to "1", and the timer functions for a predetermined period of time at a step (10). During the above functioning, the toner replenishing driving motor 1053 is operated for effecting replenishing of the toner, and the step proceeds to a step (11) by the turning off of the timer. After the output port has been set to "0" at the step (11), the step is reverted to the step (2). On the other hand, in the case where the toner concentration count number is larger than the comparison value, the step is reverted from the step (8) to step (2).

In the above specific example described thus far, the magnetic head 1031 is employed as the detecting portion 103, and the magnetic and electric converting device 104 is constituted by the Colpitts oscillation circuit 1041, operational amplifier 1042 and Schmidt trigger gate 1043, while the driving and control circuit 105 comprises the micro-computer 1051 for comparison, calculation and control, transistor 1052 for switching control, and driving motor 1053 for toner replenishing.

Figure 7:
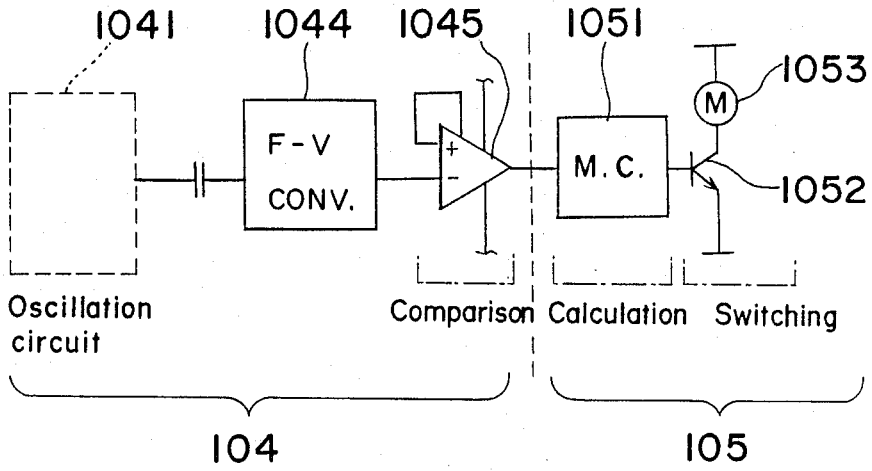
FIG. 7 is a fragmentary circuit diagram showing a modification of the circuit arrangement of FIG. 5.

However, the circuit in FIG. 6 as described above may be replaced, for example, by a modified circuit arrangement as shown in FIG. 7, in which an F-V converter 1044 is provided after the Collpitts type oscillation circuit 1041 so as to convert the output voltage into binary digit through a comparator 1045 to be applied to the micro-computer 1051.

Figure 9:
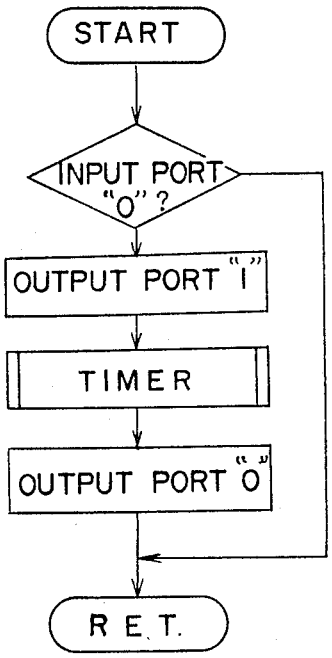
FIG. 9 is a flow-chart explanatory of control of a micro-computer employed therein.

In the above case, the flow-chart for the micro-computer 1051 may be the same as that for FIG. 8 to be described later, in which the state of the input port connected to the comparator 1045 is checked so as to replenish the toner at the state of "0" (FIG. 9).

Subsequently, in the electrophotographic copying apparatus described thus far, if it is desired to obtain a copy of high density or of low density, this is readily achieved by increasing or decreasing the exposure amount correspondingly. More specifically, since the potential Vi in the non-image portions approaches zero upon an increase of the exposure amount, the potential difference ΔV with respect to the bias voltage impressed on the developing sleeve 42 is increased, with a consequent increase of the amount of micro-carrier particles (mC) adhering to the non-image portions, and thus, the rotation of the toner replenishing roller 102 is stopped in response to the detected signal described earlier. In other words, upon an increase of the exposure amount, the toner concentration is balanced at a low point. On the other hand, when the exposure amount is decreased, the lowering of the potential Vi in the non-image portion is small, with a consequent decrease of the potential difference ΔV due to the bias voltage, and thus, the amount of micro-carrier (mC) adhering to the non-image portion is decreased. Therefore, the toner replenishing roller 102 is rotated through the detection signal, and thus, the toner concentration control is automatically effected.

Figure 4:
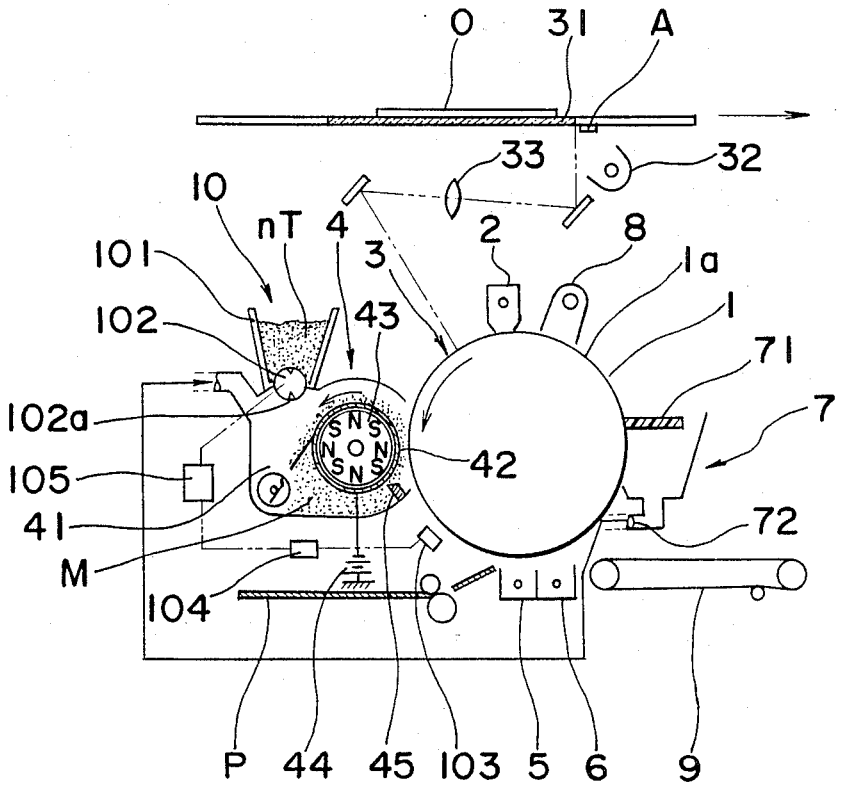
FIG. 4 is a view similar to FIG. 1, which particularly shows a modification thereof.

Referring to FIG. 4, there is shown a modification of the electrophotographic copying apparatus of FIG. 1, to which modification a second method of controlling toner concentration according to the present invention is applied.

In the arrangement of FIG. 4, there is provided a white reference image A at the leading edge of the transparent platform 31, and before illumination of the original O by the exposure lamp 32, the reference image A is illuminated, and thus, the light image of the image A is projected onto the photosensitive surface 1*a* of the drum 1 preliminarily uniformly charged by the corona charger 2 through the optical system 33 so as to form a toner concentration control latent image based on the reference image A for subsequent formation of an electrostatic latent image corresponding to the original O. The control latent image thus formed is developed by the developing device 4 during the development of the electrostatic latent image.

Since other parts of the modified arrangement of FIG. 4 are generally the same as those in the arrangement of FIG. 1, a detailed description thereof is omitted for brevity.

In the developing device 4, since the developing sleeve 42 has applied thereto the bias voltage of the same polarity (i.e. negative polarity) as the electrostatic latent image by the bias voltage source 44 to prevent the toner particles (nT) from adhering to the non-image portion of the electrostatic latent image, the potential difference of the control latent image is inverted in a similar manner as in the non-image portion (i.e. the white portion of the original O) so as to have a positive potential, and thereof, the micro-carrier particles (mC) having the negative charge adhere to the control lagent image by overcoming the retaining force of the magnet member 43 disposed in the developing sleeve 42. The amount of micro-carrier particles (mC) adhering to the control latent image as described above increases in proportion to the amount of charge on the micro-carrier particles (mC). In other words, there exists a relation that the amount of adhered micro-carrier particles increases as the mixing ratio of the toner particles (nT) in the developing material increases.

In connection with the above, experiments were carried out on the above relation as follows.

EXAMPLE 2

Under the same condition as in EXAMPLE 1 except that the potential Vi of the toner concentration control latent image based on the reference image A was set to −100 V and −200 V through variations of the amount of light emitted by the lamp 32 by the operation of the control knob (not shown) referred to earlier, the relation between the amount of micro-carrier particles (mC) adhering and toner concentration (i.e. mixing ratio of the toner particles (nT) in the respective control latent images was investigated, the results of which were generally the same as in EXAMPLE 1 as shown in FIG. 2. Meanwhile, the relation between the amount of charge on the toner particles (nT) and the toner concentration (i.e. mixing ratio of the toner particles (nT)) was also found to be generally similar to that in EXAMPLE 1 as shown in FIG. 3.

From the results of the experiments as described above, it is seen that the control latent image based on the white reference image A is capable of effecting toner concentration control in exactly the same manner as the non-image portion (in white) of the latent image of the original O. Accordingly, the method based on the reference image A as described above can effect an accurate control of the toner concentration, even when the non-image portion of the original O is colored, and the detection of the amount of the micro-carrier particles (mC) adhered after the development of the control latent image is effected at such a time that the detection signal from the detecting section 103 functions only during passing of the control latent image. The synchronization as described above may be carried out, for example, in such a manner that upon starting of scanning by the transparent plate 31 or starting of illumination of the reference image A, the detecting section 103 and magnetic and electric conversion device 104 are actuated after a predetermined periof of time by a timer or drum can or the like (not shown).

In the electrophotographic copying apparatus employing the reference image A as described above, when it is desired to obtain a copy of high density or of low density, this is readily achieved by increasing or decreasing the exposure amount correspondingly. More specifically, since the potential Vi of the control latent image approaches zero upon an increase of the exposure amount, the potential difference ΔV with respect of the bias voltage impressed on the developing sleeve 42 is increased, with a consequent increase of the amount of micro-carrier particles (mC) adhered onto the control latent image and thus the rotation of the toner replenishing roller 102 is stopped by the detected signal described earlier. In other words, upon an increase of the exposure amount, the toner concentration is balanced at a low point. On the other hand, when the exposure amount is decreased, the lowering of the potential Vi of the control lagent image is small, with a consequent decrease of the potential difference ΔV due to the bias voltage, and thus, the amount of the micro-carrier (mC) adhered to the control latent image is decreased. Therefore, the toner replenishing roller 102 is rotated in response to the detection signal, and thus, the toner concentration control is automatically effected.

In the foregoing embodiment, although the amount of micro-carrier (mC) adhered is arranged to be detected by magnetic detection, the arrangement may be modified to achieve a similar effect, for example, by detecting the amount of micro-carrier particles (mC) adhering by an optical detecting system in the form of a light reflection density as disclosed in U.S. Pat. No. 3,348,521, in which case, there may be employed an illuminating lamp and a photoelectric element (not shown) for the detecting section 103, and a light-electricity conversion device (not shown) for the conversion device 104.

Figure 8:
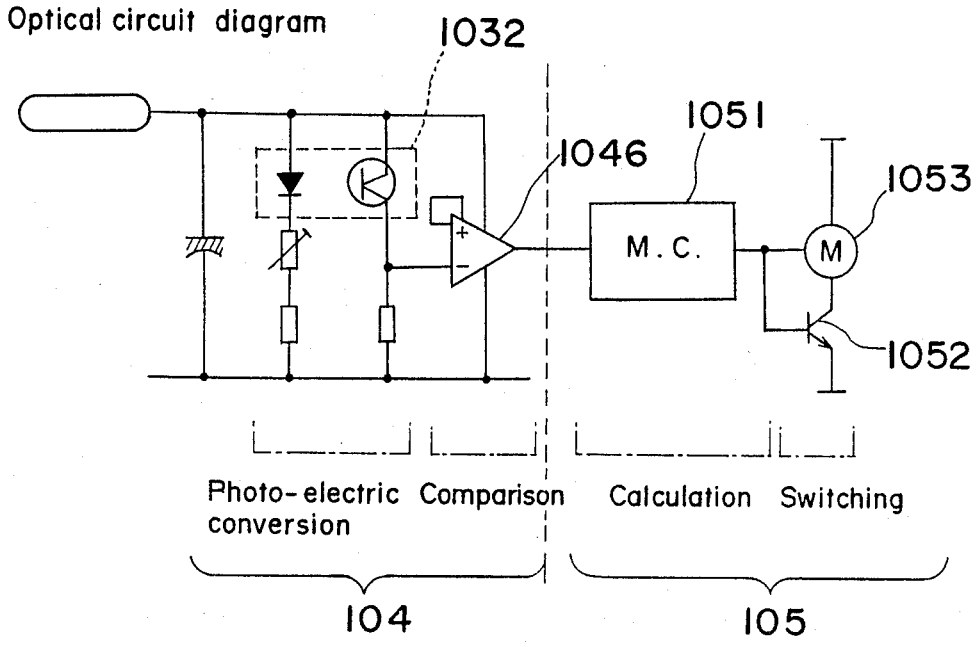
FIG. 8 is a circuit diagram showing one specific example of an optical detecting system which may be applied to the method according to the present invention.

In the circuit diagram of FIG. 8 showing one specific example of the modified circuit arrangement (optical detecting system) as referred to above, a reflection type photo-coupler 1032 is employed for the detecting section 103 so as to detect the amount of micro-carrier (mC) adhering to the control latent image on the photosensitive drum 1 in the form of electrical signal for converting the output voltage into binary digit by a comparator 1046. The comparator 1046 compares the output with the output voltage value due to the amount of micro-carrier (mC) corresponding to the preliminarily set toner concentration, for example, at 10 wt%, and if the detected output voltage value from the photocoupler 1032 is smaller, applies "0" to the micro-computer 1051, while on the other hand, if the output voltage value is larger, inputs "1" to said micro-computer. As shown by the flow-chart of FIG. 9, the micro-computer 1051 checks the state of the input port at the step (1) in a timed relation with respect to the control latent image, and effects the toner replenishment for a predetermined period of time in the similar manner as in FIG. 6 at steps (2), (3) and (4) when the output from the comparator 1046 is "0".

Meanwhile, the white reference image A described being provided at the leading edge of the transparent platform 31 in the foregoing embodiment may be positioned at the trailing edge thereof, with a similar effect. Furthermore, the reference image A may be provided on one of the side edges of the platform 31, but in this case, it is necessary to cause the reference image A to be preliminarily charged by the corona charger 2.

It is also to be noted that the position of the detecting section 103 in the foregoing embodiment of FIGS. 1 and 4 may be so as to be between the separating corona charger 6 and the cleaning device 7 as in Japanese Laid Open Patent Application Tokkaisho No. 54-61938 referred to earlier.

Furthermore, with respect to the control of the toner replenishing roller 102, besides the rotation and stop change-over control thereof by the detection signal described in the foregoing embodiments, it may be so modified that the roller 102 is subjected to a high speed rotation and low speed rotation change-over control or a control for continuously altering the speed of rotation thereof.

It should further be noted that in the present invention, exactly the same effect may be achieved, even when the bias voltage source 44 is variable for corresponding alterations of the bias voltage, instead of varying the exposure amount.

Although the present invention has been fully described by way of example with reference to the accompanying drawings, it is to be noted here that various changes and modifications will be apparent to hose skilled in the art. Therefore, unless otherwise such changes and modifications depart from the scope of the present invention, they should be construed as being included therein.

What is claimed is:

1. A method of controlling toner concentration in an electrophotographic copying apparatus in which an electrostatic latent image formed on a photosensitive member is subjected to magnetic brush development by impression of a developing bias voltage having the same polarity as that of said electrostatic latent image and which uses a dual component developing material composed of toner particles and magnetic particles which are triboelectrically charged to polarities different from each other, said method comprising the steps of magnetically detecting the amount of said magnetic particles adhering to said photosensitive member, and supplying an amount of replenishing toner according to the amount of said magnetic particles thus detected.

2. A method of controlling toner concentration in an electrophotographic copying apparatus in which an electrostatic latent image formed on a photosensitive member by a corona charging and image exposure processes is subjected to magnetic brush development by impression of a developing bias voltage having the same polarity as that of said electrostatic latent image and which uses a dual component developing material composed of toner particles and magnetic particles which are triboelectrically charged to polarities different from each other, said method comprising the steps of forming the electrostatic latent image corresponding to an original to be copied on the photosensitive member through exposure of the original and forming a non-image portion in white each time an original is exposed, developing the non-image portion of the electrostatic latent image which has an inverted developing potential difference by said bias voltage during the developing process, magnetically detecting the amount of the magnetic particles adhering to said non-image portion, and supplying an amount of replenishing toner according to the amount of said magnetic particles thus detected.

3. A method of controlling toner concentration in an electrophotographic copying apparatus in which an electrostatic latent image formed on a photosensitive member is subjected to magnetic brush development by impression of a developing bias voltage having the same polarity as that of said electrostatic latent image and which uses a dual component developing material composed of toner particles and magnetic particles which are triboelectrically charged to polarities different from each other, said method comprising the steps of forming a toner concentration control latent image on the photosensitive member by exposure thereto of a white reference image provided in a position different from that of the original each time the original is exposed, developing said toner concentration control latent image which has an inverted developing potential difference by said bias voltage during the developing process, detecting the amount of the magnetic particles adhering to said control latent image and supplying an amount of replenishing toner according to the amount of said magnetic particles thus detected.

4. A method as claimed in claim 3, wherein said detection of the amount of said magnetic particles is effected through magnetic detection of said magnetic particles.

5. A method as claimed in claim 3, wherein said detection of the amount of said magnetic particles is effected through optical detection of said magnetic particles.

6. A method as claimed in claim 1, wherein said magnetic particles are particles having diameters in the range of 5 to 40 $\mu$m and being electrically insulative resin having fine magnetic particles dispersed therein and having a resistance value higher than $10^{10}\Omega$.cm.

7. A method as claimed in claim 2, wherein said magnetic particles are particles having diameters in the range of 5 to 40 $\mu$m and being electrically insulative resin having fine magnetic particles dispersed therein and having a resistance value higher than $10^{10}\Omega$.cm.

8. A method as claimed in claim 3, wherein said magnetic particles are particles having diameters in the range of 5 to 40 $\mu$m and being electrically insulative resin having fine magnetic particles dispersed therein and having a resistance value higher than $10^{10}\Omega$.cm.

* * * * *